US006186279B1

(12) United States Patent
Blocker et al.

(10) Patent No.: US 6,186,279 B1
(45) Date of Patent: Feb. 13, 2001

(54) LOW-RISE VEHICLE LIFT FOR USE OVER A PIT

(76) Inventors: Ron Darrell Blocker, 4552 FM 1820, Chico, TX (US) 76431; Mark McMullen, 1225 FM 368 S., Iowa Park, TX (US) 76367

( * ) Notice: Under 35 U.S.C. 154(b), the term of this patent shall be extended for 0 days.

(21) Appl. No.: 09/353,265

(22) Filed: Jul. 14, 1999

(51) Int. Cl.[7] ..... B66F 7/08
(52) U.S. Cl. ..... 187/206; 187/211
(58) Field of Search ..... 187/203, 204, 187/205, 206, 207, 208, 209, 210, 211, 216, 221

(56) References Cited

U.S. PATENT DOCUMENTS

| | | | | |
|---|---|---|---|---|
| 1,847,719 | * | 3/1932 | Hirschel | 187/204 |
| 3,223,251 | * | 12/1965 | Rothe et al. | 187/208 |
| 3,255,711 | * | 6/1966 | Kiraly | 187/221 |
| 3,789,958 | * | 2/1974 | Masaitis | 187/206 |
| 4,319,666 | * | 3/1982 | Hunter | 187/207 |
| 4,447,042 | * | 5/1984 | Masui | 187/207 |
| 4,491,194 | * | 1/1985 | Mountz | 187/204 |
| 4,506,866 | * | 3/1985 | Horn | 187/208 |
| 4,690,250 | * | 9/1987 | Bergstrom | 187/207 |
| 4,715,477 | * | 12/1987 | Suzuki | 187/219 |
| 4,724,930 | * | 2/1988 | VanLierop | 187/208 |
| 4,825,977 | * | 5/1989 | Isogai | 187/203 |
| 4,848,732 | * | 7/1989 | Rossato | 187/208 |
| 4,856,618 | * | 8/1989 | Isogai | 187/208 |
| 4,909,357 | * | 3/1990 | Kawada | 187/207 |
| 5,009,287 | * | 4/1991 | Starr | 187/219 |
| 5,031,726 | * | 7/1991 | Wakamiye | 187/211 |
| 5,040,637 | * | 8/1991 | Hawk | 187/206 |
| 5,156,238 | | 10/1992 | Matthews | 187/8.72 |
| 5,184,930 | * | 2/1993 | Kuhn | 187/208 |
| 5,322,143 | | 6/1994 | Curran | 187/8.49 |
| 5,340,082 | | 8/1994 | Holloway | 254/88 |

FOREIGN PATENT DOCUMENTS

| | | | | |
|---|---|---|---|---|
| 1003025 | * | 9/1965 | (SU) | 187/203 |

* cited by examiner

*Primary Examiner*—Robert P. Olszewski
*Assistant Examiner*—Paul T. Chin
(74) *Attorney, Agent, or Firm*—Charles D. Gunter, Jr.

(57) ABSTRACT

A low-rise vehicle lift for use above a pit having side rails rising above a working surface. The vehicle lift comprises a pair of spaced apart base units coupled to corresponding vehicle support units through a lifting means. The lifting means can be a set of legs in either a parallel or scissor configuration. The base units are typically placed parallel to one another straddling the pit and side rails, the base units and vehicle support units coupled together by an adjustment bar. The adjustment bar is attached to the vehicle support units such that a space is provided for allowing the side rails to freely move within when the lift is in a lowered position.

5 Claims, 4 Drawing Sheets

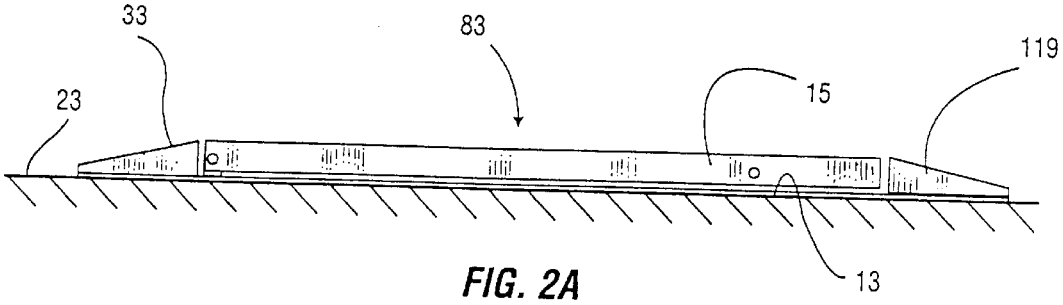
FIG. 2A
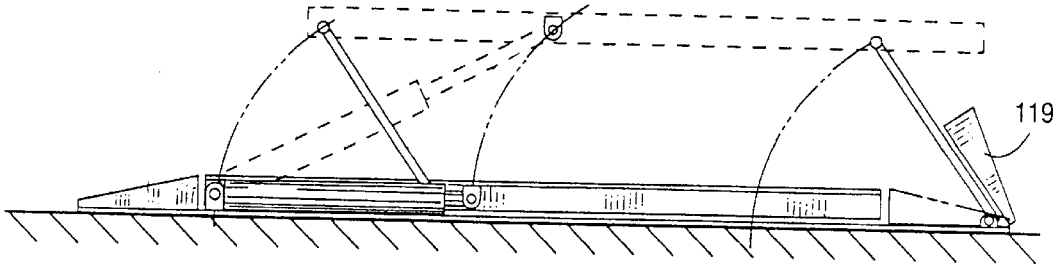
FIG. 2B
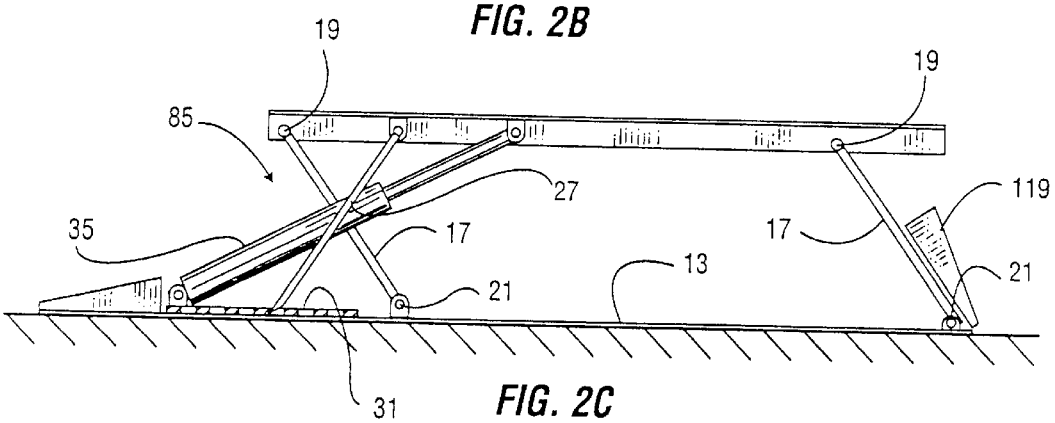
FIG. 2C
FIG. 7
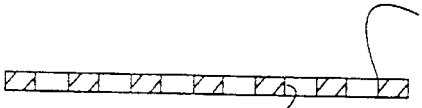
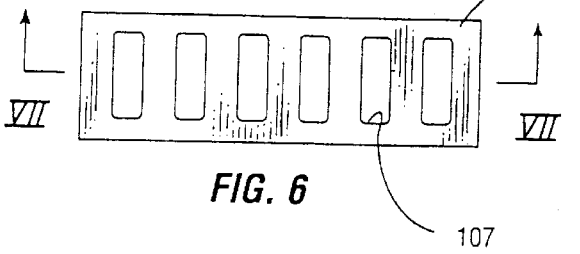
FIG. 6

LOW-RISE VEHICLE LIFT FOR USE OVER A PIT

BACKGROUND OF THE INVENTION

1. Field of the Invention

The present invention relates to hydraulically powered lifts for vehicles, and in particular for vehicle lifts that are used on a solid surface having a pit, the lift straddling the pit.

2. Description of the Prior Art

Vehicle and automotive repair establishments often must be able to raise the vehicle, such as a car, truck, etc. The vehicle must be raised to various levels depending upon the task to be performed by the service personnel. In many applications, such as vehicle body repair, tire rotation, front end alignment, brake servicing, as well as new and used vehicle preparation and reconditioning, the desired height may be limited, thus necessitating the use of a "low-rise" surface mounted lift as distinguished from below ground buried lifting cylinders. Such low-rise lifts are typically bolted to the surface of the floor of a service bay in a garage, and some can be mounted on wheels for mobility.

The problem with many of these prior art low-rise lifts is that they are not made to fit newer garages designed to have a pit. In many new vehicle repair and service establishments, a working surface such as a concrete surface is placed above an open space or pit that it typically 2.5 to 3 feet in width and several feet in length. Service personnel can then go into the pit and service a vehicle driven and parked over the pit, the two wheels on either side of the vehicle straddling the pit.

In most garages with pits, the pit is lined on its upper edge adjoining the working surface with a rail. rail is typically "L" shaped in cross-section, having one edge (or afoot safety guard) extending and rising from the working surface from 2–4 inches, and the other edge forming a holding surface for such implements as an oil pan. This rising edge of the rail creates a discontinuity in the working surface of the garage wherein presently used low-rise lifts will not operate properly. The use of a low-rise lift under such circumstances necessitates, at a minimum, having to cut the rail edge that rises from the surface. Since the rail is typically hardened steel or iron, this is difficult and time consuming as well as unsafe.

Further, most low-rise lifts have cross-members joining the two lift platforms, the cross members further hampering its use over a pit where access from below the vehicle in the pit is partially blocked. This can also create a safety problem for the workers below who can injure themselves by hitting their heads on a stationary cross member. Also, the prior art cross-members were not adjustable to accommodate pits or vehicles of various widths. Since most low-rise lifts to date are not made for use in a pit, there is a need for an improved lift for such use. The lifts that do not employ cross members joining the two spaced apart platforms are unsafe and unreliable. As the lift wears, the two sides begin to lift independently at different rates since no cross member is present to join the sides. The vehicle being lifted is lifted at an angle which could result in the vehicle falling off the lift. The lack of a cross member decreases cross lead stability.

SUMMARY OF THE INVENTION

One object of the present invention is to provide a low-rise vehicle lift for use on a working surface with a pit.

Another object of the present invention is to provide a vehicle lift wherein the distance between the tire-lifts is adjustable to fit various sized pits and vehicles.

Yet another object of the present invention it to provide a simplified low-rise lift as compared to the prior art which has fewer parts and which is easier to assemble.

Yet another object of the present invention is improve the safety of vehicle lifts by having an adjustment bar that can be moved away to avoid workers below in a pit, and a safety support arm that can be adjusted to within 1 inch, thus precluding accidental slippage of the lift from a raised to a lowered position.

Another object of the invention is to provide a vehicle lift with cross members which add stability and reliability and yet which do not require cutting away the pit guard or raise the lift above the pit guard by building up the floor on the surface that supports the lift.

The objects of the present invention are achieved by providing a vehicle lift for use above a pit having side rails rising above a working surface. The vehicle lift comprises a pair of spaced apart base units that make contact with the working surface, each base unit having a corresponding vehicle support unit. A lifting means for moving the vehicle support unit between a lowered position and a raised position relative to said corresponding base units is provided. The lifting means can be either parallel or scissor configured legs that hold the vehicle support and the vehicle parked thereupon. The base units are placed parallel to one another and separated by a distance from one another sufficient to clear a pit with side rails, the corresponding vehicle support units being coupled to one another by an adjustment bar. In order to facilitate its use over a pit having side rails, the adjustment bar clears the pit side rails when the vehicle support unit is in the lowered position.

Additional objects, features and advantages will be apparent in the written description which follows.

BRIEF DESCRIPTION OF THE DRAWINGS

FIG. 2A is a side view of the lift in the lowered position; FIG. 2B is a side view of the lift being placed in the raised position; and FIG. 2C is a side view of the lift in the raised position;

FIG. 6 is a top view of the stopblock of the invention; and

FIG. 7 is a cross-sectional view taken along lines VII—VII in FIG. 6.

DETAILED DESCRIPTION OF THE INVENTION

Figure 1:
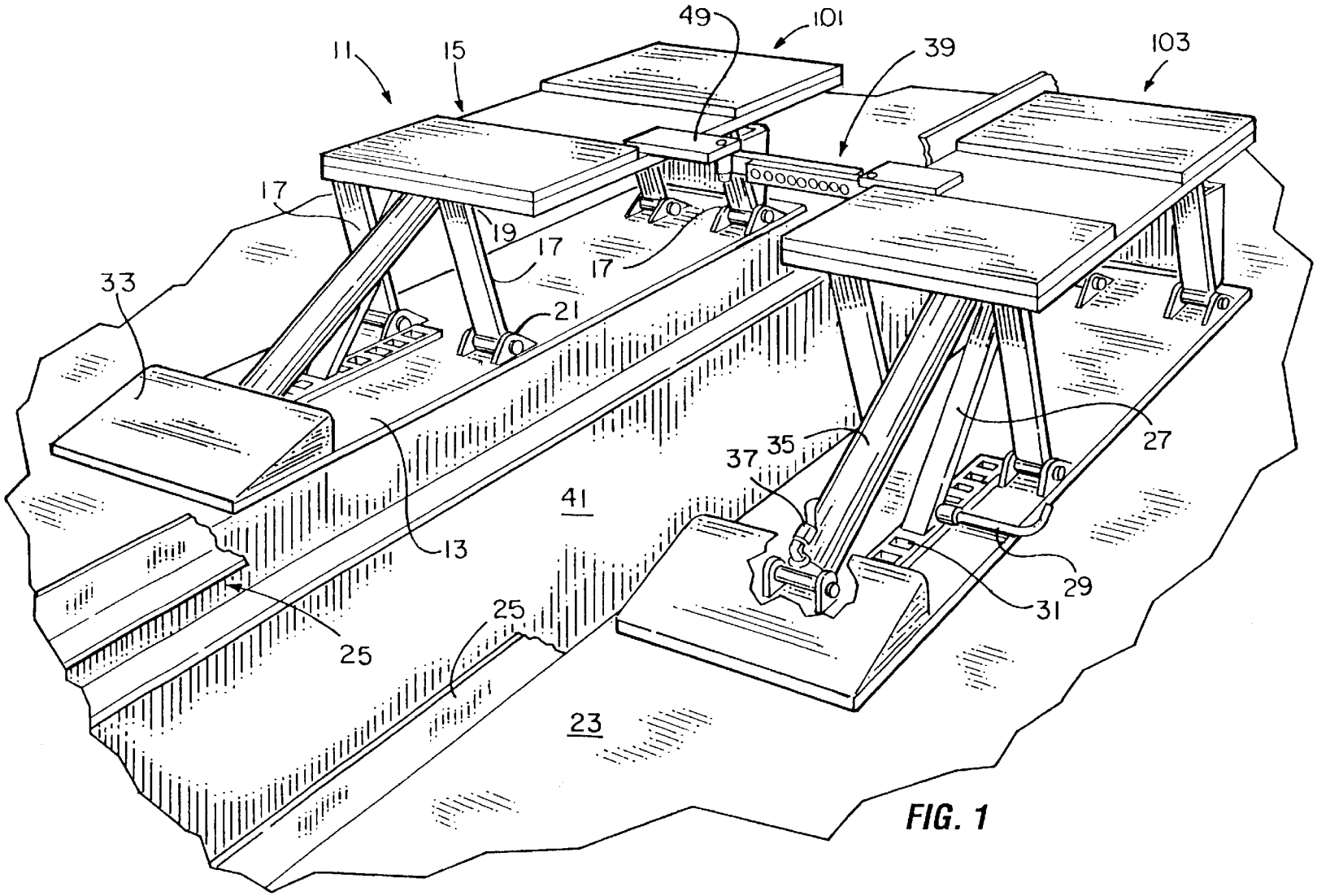
FIG. 1 is a perspective view of the low-rise vehicle lift of the invention.

Vehicle lift 11 is described first with reference to FIG. 1. A pair of spaced apart base units 13 make contact with working surface 23. The base units 13 are typically affixed to the working surface 23 by an appropriate fastening means such as a bolt, adhesive, etc. Working surface 23 is typically a hard surface made from concrete or similar material. Each base unit has a corresponding vehicle support unit 15. One base unit 13 and one vehicle support unit 15 and their associated elements form tire-lifts 101 and 103. It is advantageous to have two tire-lifts 101 and 103 to lift at least the front end or back end of a typical 4-wheeled vehicle, the front wheels of the vehicle being driven onto the vehicle support units 15. The lifts 101 and 103 can be designed to fit both front and back tires simultaneously, thus lifting the entire car. Hereinafter, the vehicle lift 11 will be described by referring to only one set (101 or 103) of tire-lifts. It is to be understood that both tire-lifts 101 and 103 are substantially mirror-images of one another, and the vehicle lift 11 refers to both tire-lifts.

The vehicle support unit is provided with ramp 33 shown in FIG. 1. This allows a vehicle to be more easily driven onto the vehicle support unit 15. Also, safety bar 27 is pivotally coupled to the vehicle support unit 15 to allow an arcuate movement parallel to the axis of the base unit. The safety bar 27 extends downward to make frictional contact with stop-block 31, the stopblock having a plurality of spaced detents 107, shown in more detail in FIGS. 6 and 7. The detents are spaced about 1 inch apart from one another. Most prior art vehicle lifts have safety bars and stopblocks with detents spaced about 4 inches apart. The stopblock 31 of the present invention creates a safer lift by preventing the vehicle support units 15 from falling as in prior art devices.

Thus, even with slippage in the present invention, the safety bar will catch onto a detent that is closely spaced together, preventing a great amount of force from being created in the slipping of the bar. The handle 29 allows the service personnel to easily adjust the position of the safety bar 27 from one detent 107 to another.

Referring back to FIG. 1, a lifting means is provided for moving the vehicle support unit 15 between a lowered position 83 (FIG. 2A) and a raised position 85 (FIG. 2C). FIG. 1 shows the vehicle lift 11 in a raised position. The lifting means in the present embodiment is a set of parallel legs 17 placed between the base unit 13 and vehicle support unit 15. The legs 17 are attached to the base unit 13 with hinge 21 and at the vehicle support unit 15 with hinge 19 (not shown). It is to be understood that, although four legs are shown on each of the tire-lifts 101 and 103, three, five, or any other number of legs is suitable. Further, the legs can be in a scissor configuration as disclosed in U.S. Pat. No. 5,322,143.

A hydraulic piston 35 having hydraulic line 37 coming from an external control unit (not shown) controls the movement of the vehicle support unit 15 relative to the base unit 13. Thus, the piston being operatively coupled to the base unit 13 and corresponding vehicle support unit 15 raises the support unit 15 when in the extended position (also shown in FIG. 2C), and lowers the support unit 15 when in the distended position. The external control unit typically controls both hydraulic pistons 35 simultaneously, thus evenly lifting and lowering the vehicle. A suitable control unit can be obtained commercially from a number of sources and will be familiar to those skilled in the relevant arts.

The function of the vehicle lift 11 is shown with reference to FIGS. 2A through 2C. The vehicle lift 11 is in a lowered position 83 in FIG. 2A, wherein the vehicle support unit 15 is about 2–4 inches above the base unit 13, the base unit being substantially flat against the working surface 23. Ramps 33 and 119 facilitate a vehicle being driven upon the support unit 15. Once a vehicle's front or back two wheels are centered upon the support unit 15, the hydraulic piston 35 is activated from its retracted position towards its extended position, moving the vehicle support unit 15 as shown by the arrows in FIG. 2B. Once in its desired position as shown in FIG. 2C, the safety support arm 27 can be engaged with a detent 107 of the stopblock 31. This locks the vehicle support unit 15 in position, keeping the vehicle parked upon the support unit 15 and safely in position while service personnel can work in the pit 41 below.

Figure 5:
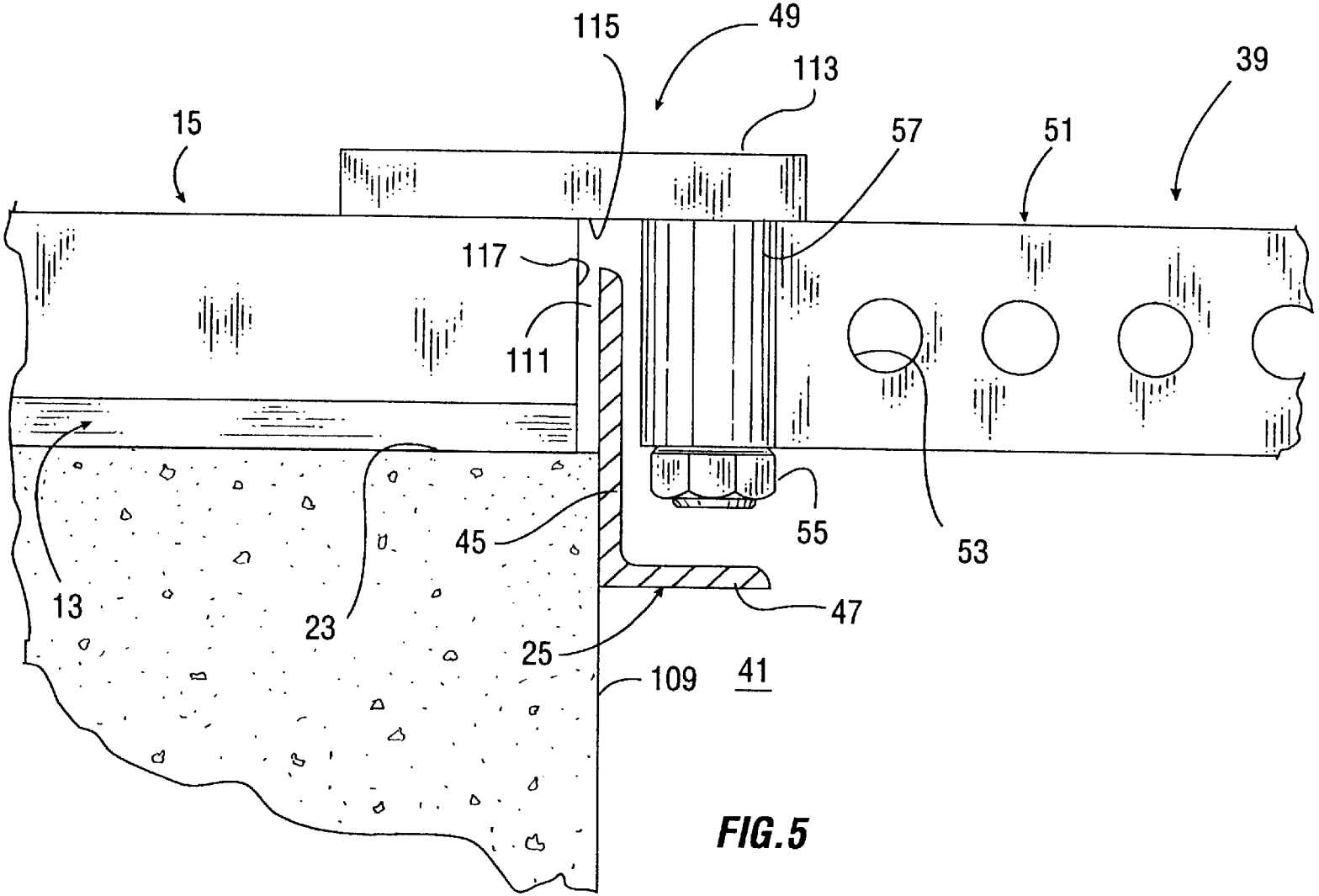
FIG. 5 is a close-up detailed cutaway view of one of the adjustment arms and its pivotal coupling to the vehicle support unit.

The pair of base units 13 are typically placed parallel and spaced from one another so as to straddle the pit 41 cut into the working surface 23. Typically, the pit 41 will have side rails 25 on either side of the pit. The side rail is typically "L" shaped in cross-section as shown in FIG. 5, having a vertical edge 45 and horizontal edge 47. The base units 13 are separated by a distance from one another sufficient to clear, and preferably to just clear the side rails of the pit so as to be immediately adjacent to the side rails 25.

Figure 3:
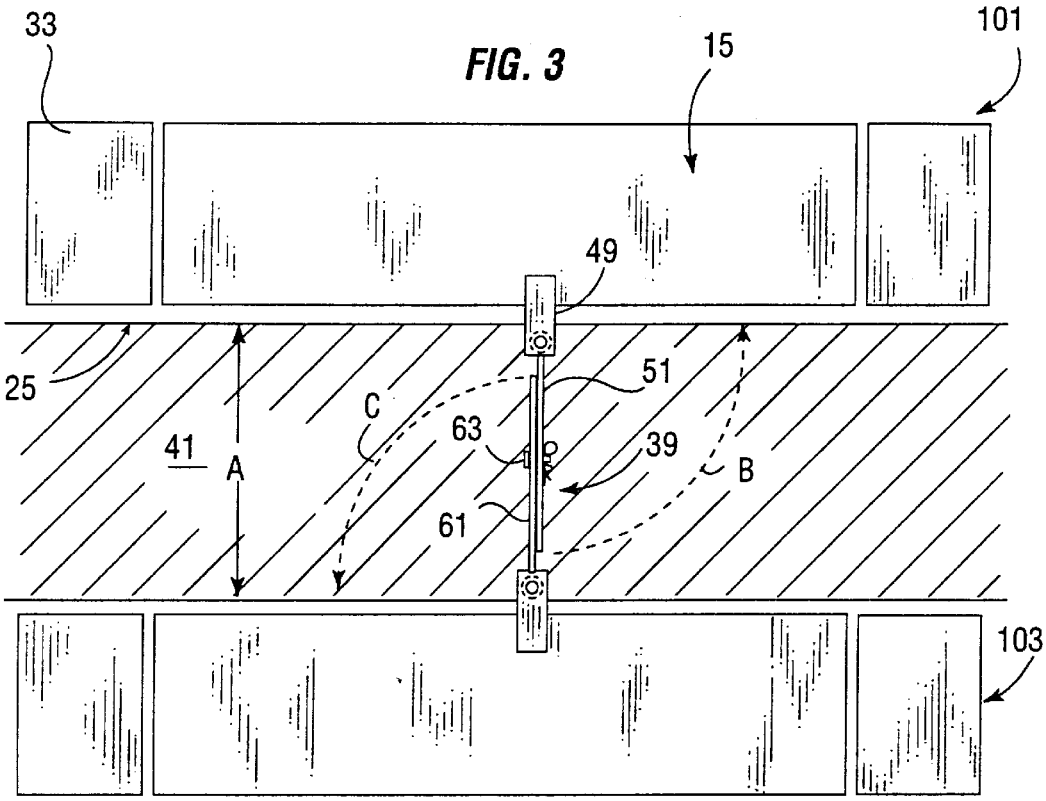
FIG. 3 is a top view of the vehicle lift of the invention.
Figure 4:
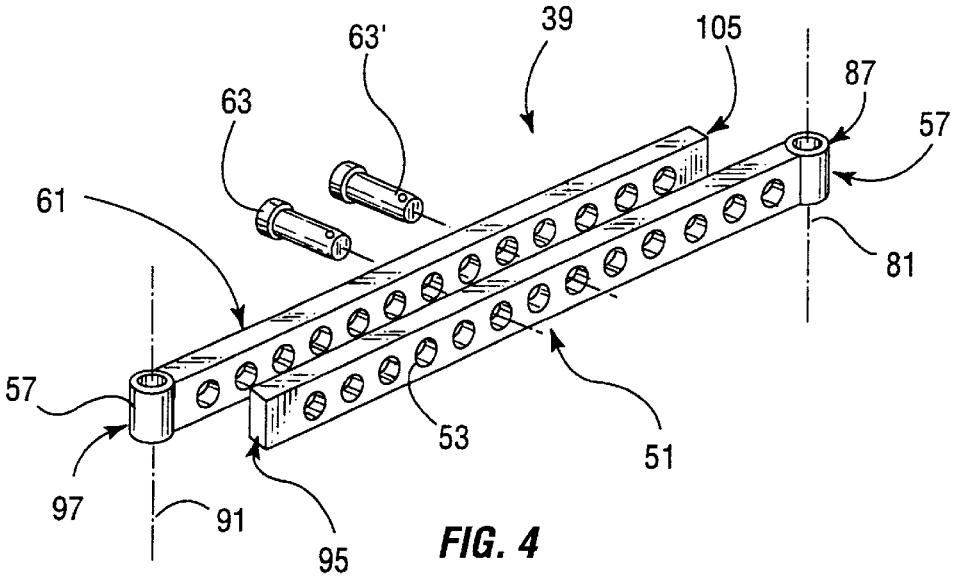
FIG. 4 is a detailed view of the adjustment arms of the invention.

Referring back to FIG. 1, the vehicle lift 11 has an adjustment bar 39. The spaced apart tire-lifts 101 and 103 are coupled together by adjustment bar 39, the bar typically straddling pit 41. Referring now to FIGS. 3 and 4, the adjustment bar 39 has a first adjustment arm 51 and a second adjustment arm 61, each arm having a proximal ends 87 and 97, respectively, and a distal ends 95 and 105, respectively. The proximal ends of the adjustment arms 51 and 61 are attached to support flange 49, the support flange 49 being coupled to the vehicle support unit 15 by an appropriate fastening means such as a bolt, or soldering, etc. The adjustment arms 51 and 61 are attached through hollow hinge 57, a bolt, toggle pin, or other suitable fastening means passing through the hinge and thus allowing the adjustment bars 51 and 61 to swivel on a pivot axis 81 and 91. The adjustment arms 51 and 61 are attached by using at least one fastening element 63 such as a bolt, etc. FIG. 3 shows the swivel movement of each adjustment bar, the bars designed to swing in arcuate paths B and C from a retracted position to an extended position which is perpendicular to the axis of the vertical support unit 15.

When in the extended position, the adjustment arms come into contact as shown in FIG. 3. This allows a pin 63 or other suitable fastening means to be placed through aligned holes 53 located on each of the arms 51 and 61. Once secured, the vehicle support units 15 are secured to one another and are laterally stabilized.

Referring to FIG. 5, the vehicle lift 11 in the lowered position 83 is shown in detail, specifically highlighting the area of the lift 11 that comes into closest contact with the side rails 25 of the pit 41. Side rail 25 is attached to the edge formed by working surface 23 and the side wall 109 of pit 41. The side rail has a vertical edge 45 and horizontal edge 47, the vertical edge extending a distance 111 from the axis of the working surface 23. This creates an discontinuity in the working surface axis near the pit edge. In order to use vehicle lifts of the prior art, this discontinuity, the edge 111, must be cut. The vehicle lift 11 of the present invention allows the vehicle lift 11 clearance of the vertical edge 45, while the adjustment bar laterally stabilizes the lift.

Support flange 49 has coupled to it the adjustment arm 51, the arm having hollow hinge 57 to allow the passage of a fastening means 55 such as a bolt and nut to pass through the hinge 57. Such an attachment allows the adjustment arm 51 to swing freely as described supra. The support flange 49 is located far enough away from the working surface 23 when the vehicle lift 11 is in the lowered position 83 as to define the distance 117, the distance 117 being at least enough to allow the edge 111 of the side rail 25 to freely enter. Likewise, the support flange 49 extends a distance 113 from the vehicle support unit 15, the distance 113 being at least enough to allow attachment of the hollow hinge 57 and to leave a space 115 between the hinge 57 and vehicle support unit 15. Thus, the space created by edges 115 and 117 is at least enough to allow the edge 111 of the side rail to fit freely within. The flange 49 is typically welded on the vehicle support unit 15, and can be attached to increase or decrease the distance 115.

The vehicle lift 11 is assembled in a garage having a working surface 23 and over a pit 41 by first placing a pair of base units 13 on the working surface in a spaced apart manner so as to be on either side of the pit. The base units 13 are typically parallel and in tandem with one another. A vehicle support unit 15 is provided with each base unit 13, the two being coupled by a lifting means such as legs 17. The legs are attached by hinges which allow the movement of the vehicle support unit 15 to a raised position or a lowered position. Next, the adjustment arms 51 and 61 are swung from their retracted position against their respective vehicle support units 15 to an extended position perpendicular to the axis of the vehicle support units 15. The base and vehicle support units (tire-lifts 101 and 103) are then slightly adjusted to substantially align at least one hole 53 from each of adjustment arm 51 and 61. A toggle pin 63 or other fastening means is placed through the aligned holes to secure the arms to one another, thus forming the adjustment bar which stabilizes the vehicle lift 11.

The present invention offers several advantages over the prior art. Due to the greater use of pits in garages for service personnel to work beneath a vehicle, and the various widths that pits are designed, it has become increasingly advantageous to design a low-rise vehicle lift for such an environment. The present vehicle lift of the invention meets the needs of many current garages and auto service centers.

The vehicle lift of the present invention offers the advantage of allowing the railings typically located on the pit edge to remain intact. This allows the full use of the railing.

The adjustment bar can be retracted when not in use, adding to the safety of mechanics using the associated pit.

The safety bar is safer, sturdier than the prior art designs and is adjustable every one inch.

The distance between the tire-lifts of the present invention can be readily adjusted to fit various pit sizes or vehicle widths. The adjustment bar of the invention is simple and easy to use and offers little hindrance to a service worker located in the pit beneath the car and lift.

While the invention has been shown in only one of its forms, it is not thus limited but is susceptible to various changes and modifications without departing from the spirit thereof.

What is claimed is:

1. A vehicle lift for use above a pit having a pit width and having side rails rising above a working surface by a selected height, the lift comprising:

a pair of spaced apart base units that make contact with the working surface, each base unit having a corresponding vehicle support unit;

a lifting means for moving the vehicle support unit between a lowered position and a raised position relative to said corresponding base units;

the base units placed parallel to one another and separated by a distance from one another sufficient to clear said pit width, the corresponding vehicle support units being coupled to one another by an adjustment bar;

wherein the adjustment bar clears said selected height of said pit side rails when the vehicle support unit is in the lowered position;

wherein the adjustment bar has a first adjustment arm and a second adjustment arm, each adjustment arm having a proximal end and a distal end;

wherein the proximal end of the first adjustment arm is attached to one vehicle support unit and the proximal end of the second adjustment arm is attached to the other vehicle support unit, the adjustment arms attached to allow the arms to swivel at the point of attachment; and wherein the distal end of the first adjustment bar and the distal end of the second adjustment bar can be adjustably coupled to one another using a suitable fastening means.

2. The vehicle lift of claim 1, wherein at least one safety stopblock is provided having a plurality of detents spaced about one inch apart from one another and is coupled to each base unit.

3. A method of assembling a vehicle lift for use above a pit having a pit width and having side rails rising above a working surface by a selected height, the lift comprising:

providing a pair of spaced apart base units that make contact with a working surface and placed in parallel on either side of the pit having side rails that rise above the working surface, each base unit having a corresponding vehicle support unit;

providing a lifting means for raising the support unit between a lowered position and a raised position relative to said corresponding base units;

the base units separated by a distance from one another sufficient to clear said pit width, the corresponding vehicle support units being coupled to one another by an adjustment bar;

wherein the adjustment bar clears said selected height of said pit side rails when the vehicle support unit is in the lowered position;

wherein the adjustment bar has a first adjustment arm and a second adjustment arm, each arm having a proximal and a distal end;

wherein the proximal end of the first adjustment arm is attached to one vehicle support unit and the proximal end of the second adjustment arm being attached to the other vehicle support unit; and wherein each adjustment arm is pivotally coupled to the respective vehicle support unit and is movable through an arcuate path from a retracted position to an extended position which is perpendicular to the axis of the vehicle support unit.

4. The method of claim 3, wherein the distal end of the first adjustment bar and the distal end of the second adjustment bar can be adjustably coupled to one another using a suitable fastening means.

5. The method of claim 3, wherein at least one safety stopblock is provided having a plurality of detents spaced about one inch apart from one another and is coupled to each base unit.

* * * * *